United States Patent [19]

Takahashi

[11] 4,070,014

[45] Jan. 24, 1978

[54] WEB FOLDING APPARATUS

[75] Inventor: Shokichi Takahashi, Kawanoe, Japan

[73] Assignee: Kawanoe Zoki Kabushiki Kaisha, Kawanoe, Japan

[21] Appl. No.: 599,420

[22] Filed: July 28, 1975

[51] Int. Cl.[2] ..... B41L 1/32

[52] U.S. Cl. ..... 270/39; 270/73

[58] Field of Search ..... 270/39–40, 270/79, 70–77

[56] References Cited

U.S. PATENT DOCUMENTS

| | | | |
|---|---|---|---|
| 843,781 | 2/1907 | Wheeler | 270/39 |
| 940,933 | 11/1909 | Klein | 270/73 |
| 1,186,018 | 6/1916 | Meisel | 270/73 |
| 1,484,069 | 2/1924 | Hudson | 270/39 |
| 3,044,766 | 7/1962 | Banks | 270/73 |
| 3,048,389 | 8/1962 | Salmon | 270/73 |

*Primary Examiner*—Edgar S. Burr
*Assistant Examiner*—A. Heinz
*Attorney, Agent, or Firm*—Robert W. Fiddler

[57] ABSTRACT

An improved apparatus is disclosed, by which two individually transversely cut web pieces, successively supplied from two different sources, are each attracted by suction onto the surface of either of a pair of suction rolls disposed parallel and rotated in opposing directions, at a first point of rotation of the rolls, and carried from said first point to a point at which the two rolls are in mating relation; at this mating point of rolls, the two cut web pieces each carried by either roll are put together or overlapped and carried by the other roll to a further point of rotation of said other roll, lower to the rolls, at which they are peeled off the roll surface and folded double by either of a pair of folding bars individually operatively associated with either roll, whereby the successively supplied cut webs are folded double in an intermeshing manner and piled below the rolls. In the disclosed embodiment, two webs from two different supply sources are transversely cut with a phase difference with respect to the rotation of two suction rolls, whereby each successive pair of the folded web pieces are folded individually on opposing directions.

7 Claims, 6 Drawing Figures

WEB FOLDING APPARATUS

BACKGROUND OF THE INVENTION

The present invention relates to apparatus for rapidly continuously folding twofold cut pieces of a web or sheet-like material having an appreciable degree of air permeability, such as paper, non-woven fabric and so forth. More particularly, the invention concerns an improved web folding apparatus by which pieces of the material web, suitably cut to the prescribed length and successively supplied in pairs, are alternately folded, transversely in a manner such that each folded piece is in an intermeshing relation to its immediately preceding piece folded as well as its immediately succeeding piece.

Today, web folding machines of the mentioned type are widely in use, for example, in the manufacture of folded and compactly packed tissue papers typically for toilet use. In principle, these machines comprise such a structure in which there are provided a pair of rolls suitably driven for rotation, each roll having therein mounted at least one vise member and one tacker member. In operation, the tacker on one roll is engaged with the vise on the other roll at the prescribed point of the rotation of rolls, and presses the web piece into the mouth formed by the pair of jaws of the vise which initially are in open condition, to impart fold to the web. Then, the web held by the pair of jaws which are then closed is advanced along its path until rolls are rotated to reach a second prescribed point of rotation, at which the closed jaws are opened to release the web, completing the folding operation.

A difficulty indicated with this structure is that the rolls are complex and accordingly expensive to manufacture. Not only in theory alone but also in actuality, the complex structure is disadvantageous again in respect of the machine maintenance, which requires frequent readjustments of jaws of the vise in particular and other machine parts as well.

Another difficulty to be particularly noted derives from the structural feature such that the jaws of the vise are reciprocated to open and close through a cam and spring mechanism, and it resides in that the reciprocation of jaws not only gives rise to extremely high noises but also sets a limitation to the speed-up of the machine operation where required.

The present invention has effectively cancelled these and other difficulties with the current web folding machines, and in principle the invention proposes to utilize, in lieu of the reliance in the prior art on such a mechanical means as comprising the combination of a vise and a tacker, the force of negative pressures or suction applied through roll surfaces to web pieces for delivering the same end, in operative combination with a folding bar member, folding the same. In practice, the invention utilizes suction rolls in place of the prior art rolls having a vise and tacker mechanism, to make the entire structure of the folding machine simple, easy and inexpensive to manufacture and maintain, and effectively answer the need for enhancing the machine efficiency, with mechanical or operational noises remarkably reduced. Also, the employment of suction rolls in accordance with the present invention has greatly restricted the number of parts in current machines, such as springs and cams indispensable to a vise-and-tacker mechanism.

BRIEF SUMMARY OF THE INVENTION

The principal object of the present invention is therefore to provide an improved web folding apparatus, simple in structure and relatively easy and inexpensive to manufacture and maintain, which utilizes negative pressures or suction applied through roll surfaces to web pieces to be processed and thus dispenses with the conventional vise and tacker mechanism on rolls.

Another object of the invention is to provide a web folding apparatus improved in that the conventional rolls having the vise and tacker mechanism thereon are replaced by suction rolls, whereby the number of machine parts and mechanical or operational noises can be remarkably reduced.

A further object of the invention is to provide a web folding apparatus improved in that by providing suction rolls and thus dispensing with the complex vise-and-tacker mechanism, the apparatus is so made as can effectively answer the need today for enhancing the operation efficiency.

A still further object of the invention is to provide an improved web folding machine having suction rolls capable of attaining dual purposes, one as web folding rolls in operative association with folding bar members which the apparatus has, the other as anvil rolls for web cutter rolls which the apparatus also has for processing a continuous web material.

These and other objects, features and advantages of the invention will become apparent upon consideration of the following description of the preferred embodiment taken in conjunction with the accompanying drawings.

DESCRIPTION OF PREFERRED EMBODIMENT

Figure 1:
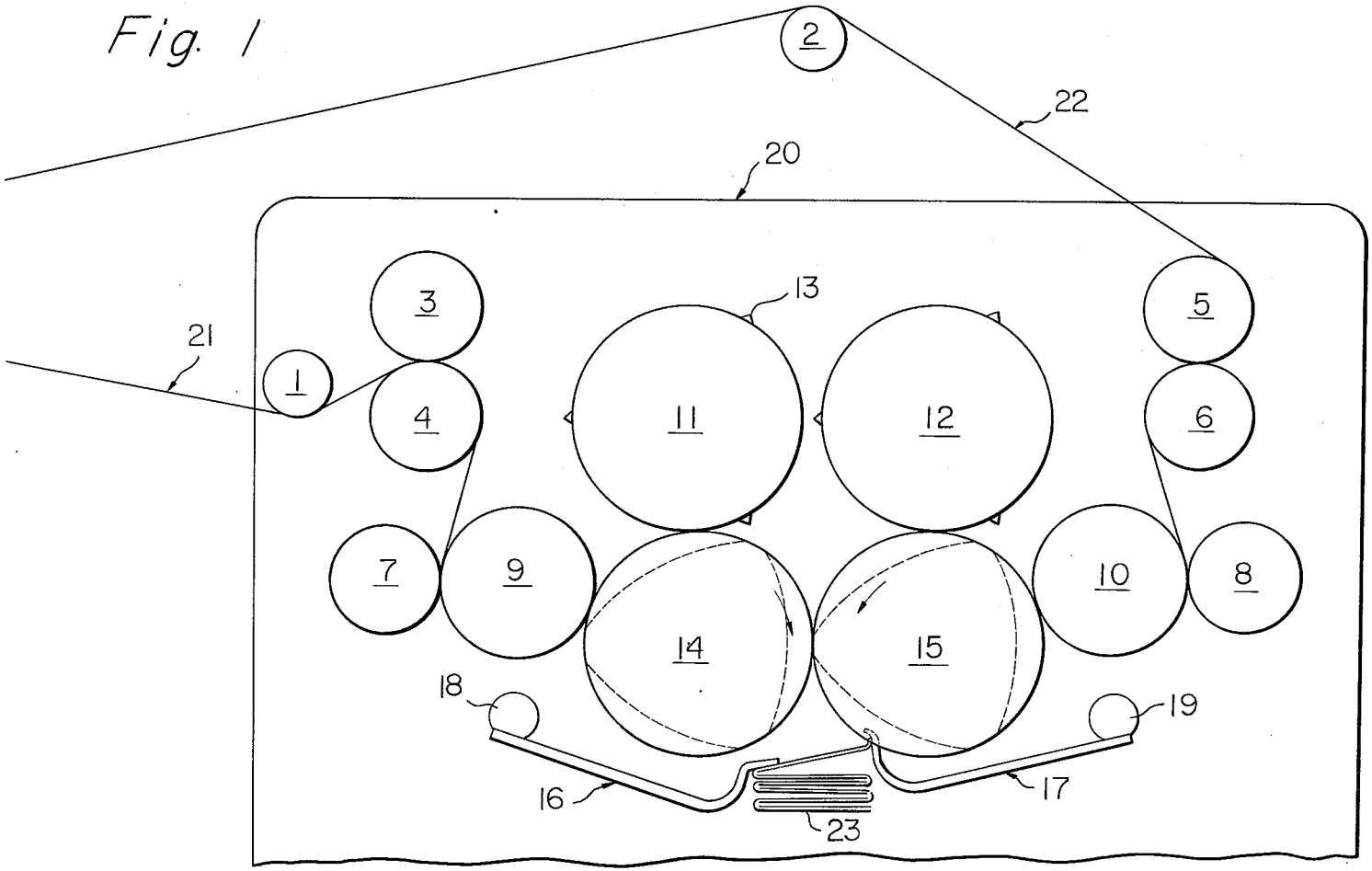
FIG. 1 is a schematic elevational view, taken for a general illustration of the principle of the present invention.

Referring to the drawings, particularly FIG. 1 initially, members therein indicated at numerals 1 and 2 are rolls for guiding into the web folding machine the material webs 21 and 22, which are continuously supplied in a pair into the machine by a pair of feed rollers 3 and 4 and another pair of rolls 5 and 6, respectively. Members shown by 7 and 8 are slitter knives and those shown by 9 and 10 are their associated slitter rolls. By the pair of the knife 7 and its engageable roll 9 and that of the knife 8 and roll 10, respectively, the webs 21 and 22 are respectively slit longitudinally or in the direction in which the webs are advanced.

Cutter rolls 11 and 12, which are provided in accordance with the present invention, are each provided with at least one cutter knife 13 for cutting the continuous webs transversely or at the right angle to said moving direction of webs. In the illustrated embodiment, each cutter roll has three knives 13 disposed at even circumferential distances on the roll. Regarding the disposition of knives 13, further, rolls 11 and 12 have a phase difference, which is 60° in the illustrated instance in which each roll has three knives. This is so that the pair of webs 21 and 22 can be cut alternately and that the cut end of either web can locate exactly at the middle of the length of a cut piece of the other web. It will be readily noted that when the number of the knife 13 mounted on each roll is reduced to 2, the phase difference between the two rolls is to be increased to 90°; if each roll has only one knife 13 thereon, then the difference is 180°.

Members 14 and 15 are suction rolls which will most importantly characterize the present invention. These rolls function in a pair and in combination with bars 16 and 17 (to be described) to fold double each cut piece of web 21 and that of web 22 alternately in a zigzag or intermeshing manner. Also, they can function as anvil rolls for cutter rolls 11 and 12 as will be described later.

Operatively associated with the suction rolls or folding rolls 14 and 15 are bar members 16 and 17 pivoted at 18 and 19, respectively, by which bars cut pieces of webs 21 and 22 attracted by suction onto the surfaces of rolls 14 and 15 are peeled off the roll surface and folded double.

The reference numeral 20 denotes a frame member of the folding apparatus, for supporting thereon the foregoing rolls and various other machine members which are not shown. The numeral 23 represents web pieces, which are alternately cut and folded double in an intermeshing manner as illustrated.

Figure 2:
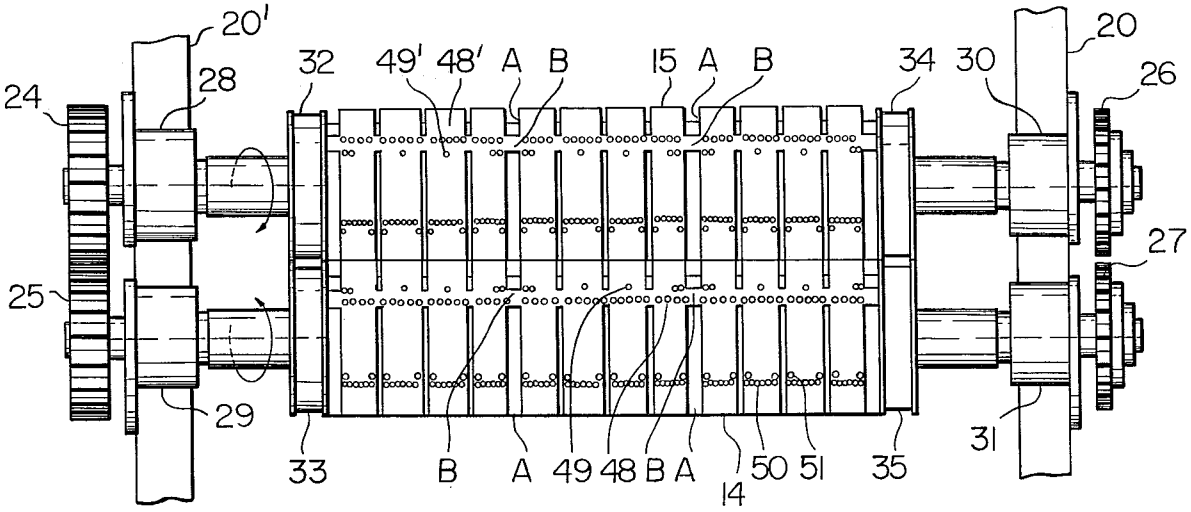
FIG. 2 is a plan view, showing the suction rolls or web folding rolls in accordance with the present invention.

In FIGS. 2 to 6, the features of the web treating apparatus or, mere particularly, suction rolls of the present invention are illustrated in greater detail, and in FIG. 2 rolls 14 and 15 are mounted through bearing cases 28, 29, 30 and 31 onto frames 20 and 20', and rotated through gears 24 and 25 of the gear ratio of 1:1, in the direction of arrows in FIGS. 1 and 2. Gears 26 and 27, which are for driving gears (not shown) for bars 16 and 17, are mutually not engageable.

Each of rolls 14 and 15 is provided with circumferentially alternately disposed two different types of suction openings (to be described), and through which openings each piece of webs 21 and 22 cut at knives 13 is attracted by suction onto the roll surface and delivered in accordance with the rotation of rolls. Rolls 14 and 15 also have grooves A for receiving thereinto bar members 16 and 17 for peeling off the roll surface and folding double the cut web pieces. With rolls in the hitherto known machines, these grooves A are so made as to be continuous through the circumference of the roll. However, in the instance of the present invention, rolls 14 and 15 have circumferentially at least one land portion as indicated by B (FIG. 3), at which the grooves ae circumferentially discontinued. With this characteristic structure according to the present invention, rolls 14 and 15 for folding cut web pieces with cooperation of folding bars 16 and 17 can also function as anvil for rolls 11 and 12 or knives 13 carried thereon, as before mentioned.

Further, similar to rolls 11 and 12, the folding rolls 14 and 15, too, have a phase difference with respect to the disposition of land portions B, and in the illustrated embodiment, the phase difference is 60°. Such phase difference, common to the cutter rolls 11 and 12 and the folding roll 14 and 15, are for purposes that a cut piece of the web 21 and that of web 22, supplied in a pair, are folded alternately, and that each folded web piece is in an intermeshing relation to its immediately preceding piece folded as well as its immediately succeeding piece.

Figure 3:
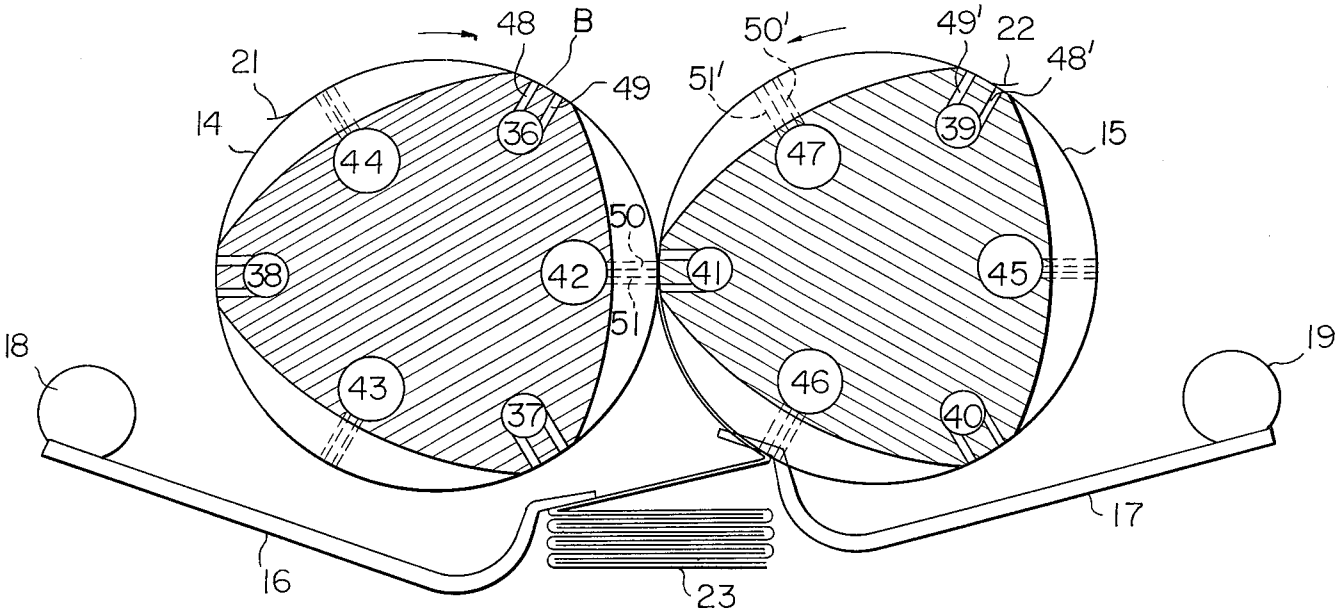
FIG. 3 is a vertical sectional view of the folding rolls in FIG. 2, also showing an elevational view of web peeling and folding means.

In FIG. 3, the structure and disposition of the aforementioned two different types of suction openings are illustrated in detail. Openings of a first type are herein named web delivering openings by way of convenience for description, which are indicated at 48 and 49 for the roll 14 and 48' and 49' for the roll 15. The second type openings, which similarly are named web folding openings, are those shown by 50 and 51 in relation to roll 14 and 50' and 51' in connection with the roll 15.

Both the web delivering openings and the web folding openings are provided in rows. The row of the former openings lies substantially along a generating line of either roll 14 or 15 running on the land portion B, while that of the latter lying substantially along a generating line of the roll running access the circumferential groove A.

Web delivering openings 48 and 49 of roll 14 are in communication with a suction conduit 36 provided longitudinally through the roll. Likewise, web folding openings 50 and 51 of roll 14 are communicated with a suction conduit 42 provided longitudinally through the roll. Each of conduits 36 and 42 is in turn communicated to a source (not shown) of negative pressures or suction disposed outside the folding machine, through vacuum rings 32, 33, 34 and 35 (FIG. 2) bolted to the ends of rolls 14 and 15 and through suction boxes (not shown) fixed to the frames 20 and 20'. The same as above mentioned in connection with the conduit 36 applies to conduits 37 and 38 of roll 14 and those 39, 40 and 41 of roll 15. Similarly, the same as mentioned in connection with the conduit 42 applies to those shown by 43 and 44 of roll 14 and 45, 46 and 47 of roll 15.

With the web delivering openings 48 and 49 or 48' and 49', the degree of suction applied thereto can limitedly be such a one as only sufficient to hold onto the roll surface either web 21 or 22, whereas with the folding openings 50 and 51 or 50' and 51'' the degree of suction should be so great as to be sufficient to hold both webs 21 and 22 at the same time. In this connection, it will be readily noted that the material web, which are to be attached by suction onto the roll surface in a pair, should necessarily have an appreciable degree of air permeability.

With the reference transferred now to FIGS. 4 to 6, a brief description will be made in the following with regard to the web folding operation with the apparatus of the invention.

Figure 4:
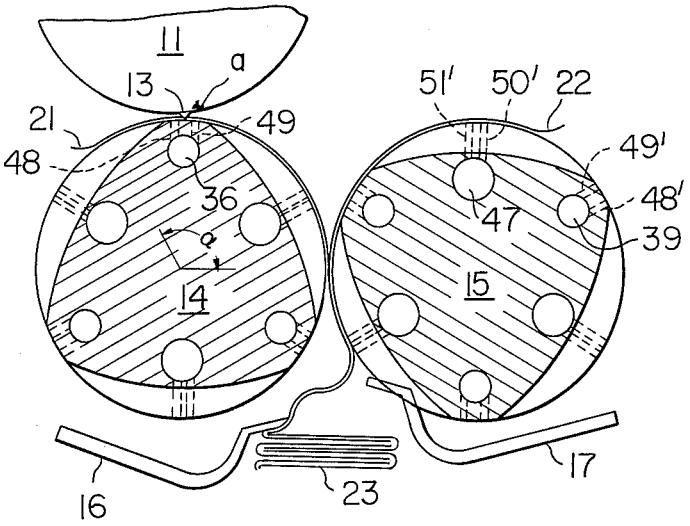
FIGS. 4, 5 and 6 are views similar to FIG. 3, taken for illustration of the web cutting and web folding steps in a preferred embodiment of the present invention.

In FIG. 4, the symbol *a* denotes the point at which the continuous web 21 is transversely cut. Closely ahead of this point *a*, the web is attracted onto the roll surface enough securely that it will not be pulled off the roll surface due to its possible sticking to the knife 13 upon cutting by same. By the suction applied through openings 48 and 49 of roll 14, each cut piece of the web 21 will be delivered for substantially such a circumferential distance on roll 14 as from slightly ahead of the point *a*, at which the application of suction is initiated, to a second point at which said openings 48 and 49 become in substantially mating relation with the web folding openings 50' and 51' of the other roll 15. Said circumferential distance on roll 14 for which the web piece is carried by roll 14 is comparable to such a period of time as required for the roll 14 to rotate for an angle of $\alpha$, which is appreciably greater than 90°.

Figure 5:
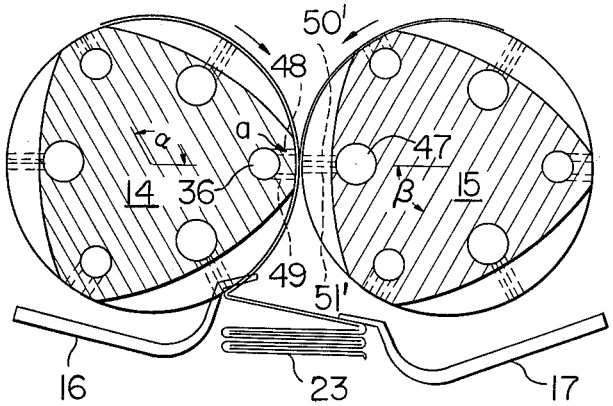
Figure 6:
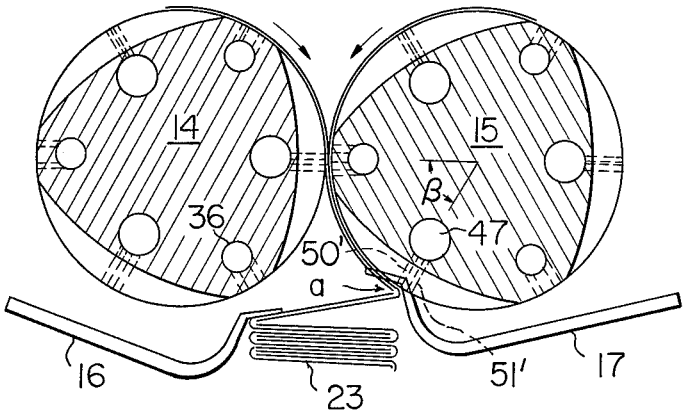

From the position illustrated in FIG. 4, rolls 14 and 15 are rotated 90° in the direction of arrows in FIGS. 2 and 3 to take the position shown in FIG. 5, at which the application of suction initiated nearly at the point *a* through the suction openings 48 and 49 through conduit 36 is cancelled. Concurrently upon this, the cut piece of web 21 is pulled onto the surface of the roll 15 by suction through openings 50' and 51' through conduit 47, together with the preceding cut piece of the web 22.

The suction application through the web folding openings 50' and 51' through the conduit 47 of roll 15, which was initiated at the above-mentioned second point, will be continued for such a period of time as requied for the roll 15 to rotated an angle of $\beta$ which will be between about 45° to about 90°. Thus, from the position shown in FIG. 5, the pair of cut pieces of webs 21 and 22 are then advanced to the position shown in FIG. 6, whereupon they are released from the suction application through the roll 15 and peeled off the roll surface by the function of the peeling-folding bar 17.

It will be readily understood that in the same manner as mentioned above in connection with the web 21, the web 22 is cut by knives 13 on the cutter roll 12 at point *a*, each cut piece of this web 22 being carried for the processing initially by roll 15 for the angular movement of $\alpha$ and then by roll 14 for the angular movement of $\beta$, followed by peeling and folding by the bar member 16.

Also, it will be readily recognized that the number of suction openings 48 to 51 and 48' to 51' and accordingly the number of conduits 36 to 47 are suitably determinable depending upon the specific type or kind of the material web and the particular specification of the manner of folding desired. Similarly, depending on the prescribed requirements, the values $\alpha$ and $\beta$ can be suitably changed, for example by employing adjustable suction boxes.

Whereas the present invention has been described and illustrated in connection with a specific embodiment, the embodiment described in conjunction with several figures of drawing can be readily modified, and therefore the scope of the present invention should not be understood to be limited to only those forms as specifically disclosed and illustrated in the foregoing specification and accompanying drawings but is to be defined and limited only by the claims which follow.

I claim:

1. Apparatus for folding cut pieces of web material supplied in pairs comprising a pair of rotatable suction rolls each having at least one circumferential groove transitioning into at least one axially oriented land portion and a pair of web peeling and folding means each operatively associated with said groove of either roll, said circumferential groove dividing the surface of said roll into circumferentially extending land portions which merge with said axial land portion, said suction rolls each having web delivering openings provided therein substantially along a generating line thereof running on said axial land portion and web folding openings provided substantially along an axial line thereof running across said groove, said web delivering openings and said web folding openings being circumferentially spaced with respect to each other so when the pair of rolls are rotated in opposing directions the web delivering openings of either roll and the web folding openings of the other roll come substantially into mating relation at a first point of rotation of the rolls, said web delivering openings of either roll providing means applying suction to said cut piece of the material web continuously from a point of rotation of the roll at which they receive thereon said cut web piece to said first point of rotation of rolls, said web folding openings of the other roll providing means applying suction to the cut web piece continuously from said first point of rotation to a further point of rotation of the roll at which the cut pieces of the web are peeled off the roll surface and folded by one of said pair of web peeling and folding means.

2. The apparatus as claimed in claim 1, wherein said web delivering openings are in communication with a source of suction of a relatively low degree through a suction conduit provided longitudinally through the rolls, and said web folding openings are in communication with a source of suction of a relatively higher degree than the suction provided by the web delivering opening through a suction conduit extending longitudinally through the rolls.

3. The apparatus as claimed in claim 1, wherein said suction rolls individually have at least one circumferential groove transitioning into two land portions, said web delivering openings being formed in rows each substantially along a generating line of the roll running along either of said two land portions, said web folding openings being formed in rows extending between said rows of web delivering openings and parallel thereto.

4. The apparatus as claimed in claim 1, wherein said suction rolls individually have at least one circumferential groove interrupted by three land portions, said web delivering openings being formed in rows individually substantially along a generating line of the roll running along each of said three land portions, said web folding openings being formed in rows extending between each adjacent pair of said rows of web delivering openings and parallel thereto.

5. A web folding apparatus comprising a pair of suction rolls each having at least one circumferential groove transitioning into at least one axially oriented land portion, a pair of web peeling and folding means each operatively associated with said groove of either roll said circumferential groove dividing the surface of said roll into circumferentially extending land portions which merge with said axial land portion, and two cutter rolls mounted for rotation adjacent said suction rolls each cutter roll having at least one cutter knife mounted thereon to cut a continuous web material transversely upon its engagement with said axial land portion of the suction roll, said suction rolls each having web delivering openings provided therein substantially along a generating line thereof running along said axial land portion and web folding openings provided substantially along an axial line thereof running across said groove, said web delivering openings and said web folding openings being circumferentially spaced with respect to each other so that when the pair of suction rolls are rotated in opposing directions the web delivering openings of either roll and the web folding openings of the other roll come substantially into mating relation at a first point of rotation of the suction rolls, means in said web delivering openings of either roll applying suction to the web continuously from appreciably ahead of a point at which said continuous web is cut by the engagement of said cutter knife on the cutter roll and said land portion of the suction roll to said first point of rotation of the rolls, means in said folding openings of the other roll applying suction to each pair of cut pieces of the web continuously from said first point to a further point of rotation of said rolls at which said cut piece of the web is peeled off the roll surface and folded by one of said pair of web peeling and folding means.

6. The web folding apparatus as claimed in claim 5, wherein said pair of cutter rolls individually have more than two cutter knives, said cutter rolls having a phase difference with respect to the disposition of said cutter knives.

7. In a web folding apparatus including two pairs of feed rolls for feeding into said apparatus two runs of web material supplied from different supply sources and means for longitudinally slitting said two runs of the web material, the improvement comprising:

two cutter rolls each cutter roll having three cutter knives mounted thereon in a circumferentially evenly spaced disposition;

two suction rolls rotatably mounted adjacent said cutter rolls, each suction roll having at least one circumferential groove transitioning into three separate axially oriented land portions individually engageable with the corresponding one of said three cutter knives to transversely cut the continuous runs of the web; said circumferential groove dividing the surface of said roll into circumferentially extending land portions which merge with the separate axial land portions and at least a pair of web peeling and folding means operatively associated with said groove;

said suction rolls each having rows of web delivering openings each formed substantially along a generating line of the roll running along each of said axial land portions and rows of web folding openings circumferentially spaced about said roll between each adjacent pair of said rows of web delivering openings and parallel thereto;

said web delivering openings and said web folding openings positioned on said suction rolls so that at a first point of rotation of the suction rolls at which said suction rolls come into contacting relation to each other, the web delivering openings of either suction roll and the web delivering openings of the other suction roll come substantially into mating relation, and the web folding openings of either suction roll, and the web folding openings of the other suction roll come substantially into mating relation;

said web delivering openings of either roll providing means carrying the web from appreciably ahead of a point at which the continuous web is cut to said first point of rotation of the rolls;

said latter openings of the other roll carrying the cut piece of the web carried by either roll as well as that carried by said other roll from said first point of rotation of the rolls to near the location at which said pair of web peeling and folding means enter said grooves;

said web peeling and folding means urging the cut web pieces outwardly and radially from said suction roll to the two cut pieces of the web carried by either suction roll from the roll and fold them double.

* * * * *